United States Patent [19]

Perkins

[11] 4,023,759

[45] May 17, 1977

[54] DISPLAY PACKAGE

[75] Inventor: William Perkins, Etobicoke, Canada

[73] Assignee: Reid Dominion Packaging Ltd., Hamilton, Canada

[22] Filed: June 29, 1976

[21] Appl. No.: 700,845

[52] U.S. Cl. ..... 248/174; 211/73

[51] Int. Cl.[2] ..... A47F 5/11

[58] Field of Search ..... 248/174, 152, 459; 211/72, 73, 60 A, 135; 206/44.11, 45.24, 45.28

[56] References Cited

UNITED STATES PATENTS

| | | | |
|---|---|---|---|
| 1,446,450 | 2/1923 | Casey | 248/174 |
| 1,687,138 | 10/1928 | Myers | 248/152 |
| 2,142,826 | 1/1939 | Rosello | 248/174 |
| 2,530,950 | 11/1950 | Ebert et al. | 248/459 |
| 3,029,051 | 4/1962 | Nichols | 248/174 |
| 3,322,383 | 5/1967 | Weinberg | 248/174 |

*Primary Examiner*—Marion Parsons, Jr.
*Attorney, Agent, or Firm*—Sim & McBurney

[57] ABSTRACT

This invention provides a self-supporting display holder having a four-panelled supporting base intended to take up an essentially triangular configuration that is arranged to support the holder vertically, and adapted to assume a collapsed configuration for shipping or storing of the display holder. Extending tabs on the holder are adapted to register with slots in at least one of the panels of the supporting base when in the triangular configuration, thereby to give stability and rigidity to the base with respect to the holder itself.

4 Claims, 6 Drawing Figures

DISPLAY PACKAGE

This invention relates generally to self-supporting display packages for merchandise items such as pens, cosmetics, etc., and has to do particularly with a display package construction which permits either flat folding for shipping and storage or a "set up" configuration in which the display package is self-supporting.

SUMMARY OF THE PRIOR ART

The prior art includes a number of display packages and display devices which are intended to support, protect and display a merchandise item such as a cosmetic tube, etc.

Generally speaking, the conventional and prior art display packages lack a completely reliable means of ensuring that the orientation of the supporting base with respect to the upstanding article-holding portion will be positively maintained in such a way as not to be threatened by the progressive deterioration of stressed panels, or by the tendency for fold lines to "pop" out of a toggle setting. One prior art device, for example, relies for its orientational rigidity upon the flexed strength of one curved panel. The disadvantage here is that, with most materials, the force with which a curved flexed panel attempts to return to its at-rest state gradually diminishes with time, and could reach the point where the structural rigidity of the device is imperiled. In another prior art device, the structural rigidity of the supporting base depends upon an over-center toggle arrangement in which a short panel goes through a dead-center position to lie against a longer panel, with the result that an essentially triangular, stable base should be created. However, this arrangement is an unreliable way of ensuring the triangular stability of the base, because it is quite conceivable that the several stressed fold lines will resist the stable configuration of the base, and "snap" the short panel outwardly through the dead-center position, thereby destroying the stable position.

OBJECTS OF THIS INVENTION

It is among the objects of this invention to provide a self-supporting display holder that includes a supporting base which may be folded away for storage and shipping, but which when set up in its supporting configuration is positively retained in a given orientation with respect to the remainder of the display holder.

It is an object of a preferred embodiment of this invention to provide a self-supporting display holder having a supporting base capable of being set up in supporting configuration, which when placed in said configuration is restrained from departing from said configuration.

GENERAL DESCRIPTION OF INVENTION

Accordingly, this invention provides a self-supporting display package comprising a card member and first and second similar leg panels all articulably connected together about substantially a common hinge line;

a first and a second intermediate panel articulably connected to each other and articulably connected to the first and second leg panel respectively at locations remote from the card member;

the leg panels and the intermediate panels being swingable between a first configuration in which all panels and the card member lie in parallel planes with the leg panels juxtaposed together and the intermediate panels juxtaposed together, and a second configuration in which the said panels define a bipedal supporting base for the card member with the joints between the leg panels and the respective intermediate panels adapted to contact a supporting surface;

the card member having two downwardly extending tabs adjacent the ends of said common hinge line, the intermediate panels defining at least one slot adapted to register with the inner edge of a tab when the panels are in said second configuration, the panels being capable of assuming a third configuration in which the two intermediate panels are inverted between said leg panels and all panels are juxtaposed in parallel contacting relation.

GENERAL DESCRIPTION OF THE DRAWINGS

One embodiment of this invention is shown in the accompanying drawings, in which like numerals denote like parts throughout the several views, and in which.

PARTICULAR DESCRIPTION OF DRAWINGS

Figure 1:
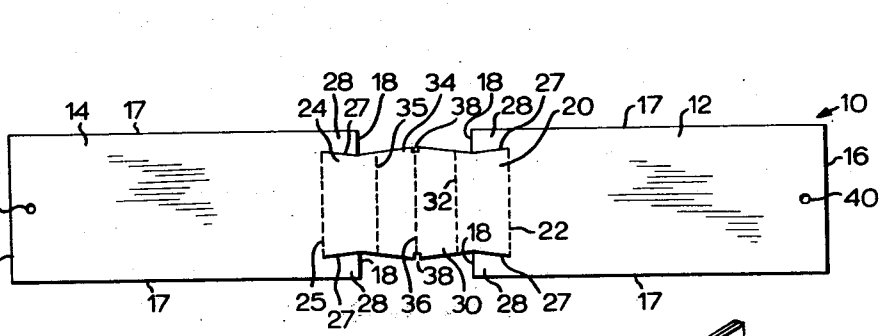
FIG. 1 is a plan view of a blank cut in accordance with this invention.

Attention is directed first to FIG. 1, in which the numeral 10 identifies a blank which may be of cardboard or any other suitable sheet material. The blank 10 includes a first main panel 12 and a second main panel 14. While both of the main panels 12 and 14 are shown to be rectangular in general outline, it will be understood from what follows that the rectangular configuration is not essential to this invention. In FIG. 1, each main panel 12 and 14 is seen to include an upper edge 16, two side edges 17 and a lower edge 18. The lower edge 18 of the first main panel 12 is centrally interrupted by a first leg panel 20 which is articulably connected to the first main panel 12 at a first fold line 22, drawn with a broken line. The lower edge 18 of the second main panel 14 is centrally interrupted by a second leg panels 24 which is articulably connected to the second main panel 14 at a second fold line 25, also drawn as a broken line. It will be seen that the first and second fold lines 22 and 25 are displaced away from the respective lower edges 18 of the two main panels, and to permit articulation of the leg panels 20 and 24 with respect to the main panels 12 and 14, two oblique cuts 27 are made in each main panel, diverging away from the lower edge 18 to the respective fold line 22, 25. It will be noted that the fold line of each main panel does not extend the full distance between the side edges of the main panel, but rather terminates short of the side edges. By reason of this configuration, each main panel 12 and 14 can be considered to define two tab portions 28, each tab portion being defined by a side edge 17, a cut 27 and part of a lower edge 18.

The first leg panel 20 is articulably connected to a first intermediate member at a third fold line 32, shown as a broken line, while the second leg panel 24 is articulably connected to a second intermediate member 34 at a fourth fold line 35, also shown as a broken line. The first and second intermediate members 30 and 34 are also articulably connected together through a fifth fold line 36, shown as a broken line. The two intermediate members 30 and 34 define, at either end of the fifth fold line 36 two open-ended slots 38, the purpose of which will shortly be explained.

The main panels 12 and 14 may include, adjacent the upper edges 16, apertures 40 for hanging or suspending the display package from a wall, etc.

To assemble the display folder of this invention, the first and second main panels 12 and 14 shown in FIG. 1 are brought together in surface-to-surface juxtaposition, and are glued or otherwise adhered together in that position. The leg panels 20 and 24 and the intermediate members 30 and 34, however, are not adhered together and remain free to articulate with respect to each other and with respect to the juxtaposed main panels 12 and 14.

In the embodiment illustrated, the blank is taken to be fully symmetrical about the fifth fold line 36, such that the entire portion to the right of the fold line 36 can simply be folded about that line to lie in coincidence with the portion to the left of the fifth fold line 36. In other words, the two main panels 12 and 14 of the first embodiment of this invention have the same configuration and dimensions, as have also the two leg panels 20 and 24, and the two intermediate members 30 and 34.

Figure 2:
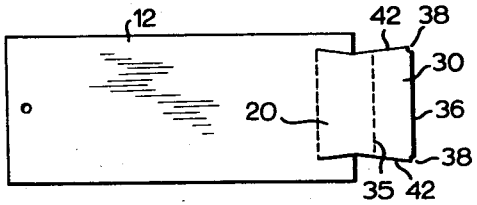
FIGS. 2 and 3 are views of the blank in assembled form, showing two flattened configurations.

FIG. 2 shows the display package immediately after the folding over of the rightward portion against the leftward portion about the fifth fold line 36.

In FIG. 2, the other side of the first main panel 12 is visible, and completely hides the second main panel 14. Likewise, it is the first leg panel 20 and the first intermediate member 30 that are visible. Because the open-ended slots 38 are aligned with the fold line 36, these slots 38 resemble removed corner portions in FIG. 2 at either end of the fold line 36.

Figure 3:
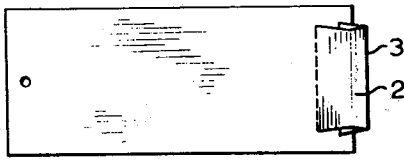

Because the leg portions 20 and 24 and the intermediate members 30 and 34 are not bonded or adhered together, and remain articulable with respect to each other and with respect to the main panels 12 and 14, it is possible to invert the intermediate members 30 and 34 by folding them inwardly between the leg panels 20 and 24, so that they again lie in a flattened condition as seen in FIG. 3.

Figure 4:
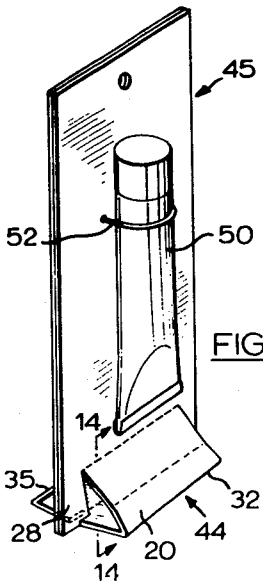
FIG. 4 is a perspective view of this invention in set-up configuration.

In folding the device from the position of FIG. 2 to the position of FIG. 3, it is necessary to go through an intermediate or "dead-center" configuration as shown in FIG. 4. It will be seen in FIG. 4 that the tab portions 28 register with, and are received in, the open-ended slots 28. For reasons shortly to be explained, it is desirable that this registry take place, and it is ensured by cutting the intermediate members 30 and 34 in such a way that their dimension immediately adjacent and parallel to the fold line 36 is greater than the spacing between the lower inner corners of the opposite tab portions 28. The open-ended slots 38 are provided at the ends of the fifth fold line 36 such that the base of each slot 38 is substantially aligned with the inner lower corner of its respective tab portion 28 in the direction perpendicular to the fold lines 32 and 35. In the particular embodiment shown, the registry is the result of cutting each leg panel and its associated intermediate member along outwardly flaring lines 42. As the tab portions 28 have oblique inner edges, the "fit" between a slot 38 and the oblique tab edge becomes progressively tighter as the slot slides down the tab portion. These parts can be dimensioned so that disengagement between them is resisted by a slight mechanical interference.

Figure 6:
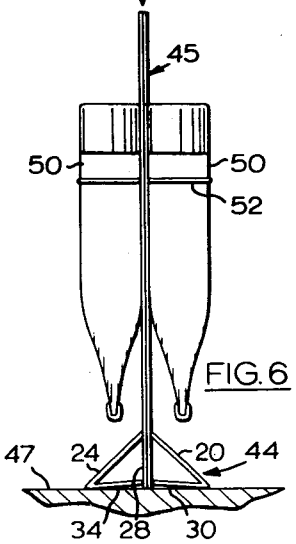

While FIGS. 2 and 3 illustrate the condition of the display package of this invention that is suitable for storage and shipping, FIG. 4 illustrates the condition of the display package in which it is capable of standing erect. In essence, the two leg panels and the intermediate members in the set-up position define a bipedal supporting base 44 for a card member 45 composed of the first and second main panels 12 and 14 adhered together in juxtaposed relation. When the first embodiment of this invention is set up as shown in FIG. 4, the third and fourth fold lines 32 and 35 are adapted to rest against a supporting surface 47, as illustrated in FIG. 6. It will also be noted in FIG. 6 that in the upright condition of the package, the bottoms of the tabs 28 are substantially coplanar with the joins between the leg panels and their respective intermediate members.

When the display package of this invention is stored and shipped in the condition shown in FIG. 3, with the intermediate members 30 and 34 folded inside the leg panels 20 and 24, the different fold lines will tend to become "set" in that condition, although the different components will tend to spring apart to some degree to relieve some of the stress on the fold lines. Generally, the components will spring apart to approximately the configuration shown in FIG. 5. It is to be understood that both in the configuration of FIG. 3 and that of FIG. 5 there is registry between the openended slots 38 and the tab portions 28.

Figure 5:
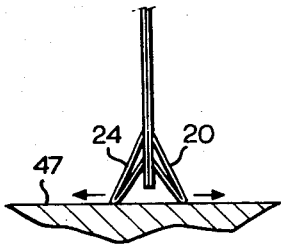
FIGS. 5 and 6 are elevational views of this invention, illustrating steps in the setting up of the base support.

In order to set up the display package in the condition shown in FIG. 6, it is merely necessary to place the package in erect condition against the supporting surface 47 as shown in FIG. 5, and then press downwardly against the card member 45. This will cause the leg panels 20 and 24 to swing outwardly while the angle between the two intermediate members 30 and 34 widens and approaches 180°. Simultaneously, the tab portions 28 descend to rest against the supporting surface 47. Because the registry between the tab portions 28 and the open-ended slots 38 is retained in the set-up condition shown in FIG. 6, the mutual orientation between the card member 45 and the bipedal supporting base 44 is rigidly maintained.

In order to obtain the condition shown in FIG. 6, it suffices to ensure that the length of the tab portions 28 (the dimension perpendicular to the fold lines) is related to the dimensions of the leg portions and the intermediate members substantially as the three sides of a right-angled triangle. More specifically, considering dimensions always in the direction perpendicular to the fold lines, the sum of the squares of the dimensions of a tab portion 28 and an intermediate member 30, 34 will be substantially equal to the square of the dimension of a leg panel 20, 24.

As shown in FIGS. 4 and 6, the card member 45 (comprising the two main panels 12 and 14 adhered together) may support two merchandise items 50, for example tubes of cosmetic material, one item being located on each side of the card member 45, and being secured thereto by attachment means such as a wire 52. It will of course be understood that any of several conventional packaging techniques may be utilized to secure a merchandise item against the card member 45.

Since the positioning of a merchandise item 50 on either side of the card member 45 essentially "balances" the display holder, it is desirable that the card member 45 be perpendicularly related to the supporting surface 47, and this invention is particularly useful in such a situation. The display package of this invention is also useful for other cases where the supported weight of the merchandise item or items can be "balanced," for example in blister packaging techniques where a display card has one or more openings or apertures in which merchandise items are centered and retained by means of plastic film.

Even when the item to be displayed is somewhat off-center with respect to the supporting base of the package, a stable configuration can be maintained so long as a vertical line through the combined center of gravity passes between the third and fourth fold lines 32 and 35 when the package is in the set-up position shown in FIG. 6.

I claim:

1. A self-supporting display package comprising a card member and first and second similar leg panels all articulably connected together about substantially a common hinge line;

a first and a second intermediate panel articulably connected to each other and articulably connected to the first and second leg panel respectively at locations remote from the card member;

the leg panels and the intermediate panels being swingable between a first configuration in which all panels and the card member lie in parallel planes with the leg panels juxtaposed together and the intermediate panels juxtaposed together, and a second configuration in which the said panels define a bipedal supporting base for the card member with the joins between the leg panels and the respective intermediate panels adapted to contact a supporting surface;

the card member having two downwardly extending tabs adjacent the ends of said common hinge line, the intermediate panels defining at least one slot adapted to register with the inner edge of a tab when the panels are in said second configuration, the panels being capable of assuming a third configuration in which the two intermediate panels are inverted between said leg panels and all panels are juxtaposed in parallel contacting relation.

2. The invention claimed in claim 1, in which the leg panels are identical and in which the intermediate members are identical, there being two said slots, one at either end of the line along which the intermediate members are connected to each other.

3. The invention claimed in claim 2, in which the card member includes two individual main panels adhered together in juxtaposition, each said leg panel being integral with one of the main panels.

4. The invention claimed in claim 2, in which the inner edge of both slots converge downwardly together, and in which the respective slots are so provided that a tight fit takes place between each slot and the lowermost portion of its respective tab, the tabs being dimensioned such that, when said tight fit takes place, the bottoms of the tabs are substantially coplanar with said joins, to give a three-point supporting stance to the display package.

* * * * *